US009988827B2

(12) United States Patent
Borenstein

(10) Patent No.: US 9,988,827 B2
(45) Date of Patent: Jun. 5, 2018

(54) MAGNETIC KEY ASSEMBLY

(71) Applicant: David Frank Borenstein, Pembroke (CA)

(72) Inventor: David Frank Borenstein, Pembroke (CA)

(73) Assignee: David Frank Borenstein, Pembroke, Ontario (CA)

( * ) Notice: Subject to any disclaimer, the term of this patent is extended or adjusted under 35 U.S.C. 154(b) by 0 days. days.

(21) Appl. No.: 15/518,862

(22) PCT Filed: Oct. 15, 2015

(86) PCT No.: PCT/CA2015/051040

§ 371 (c)(1),
(2) Date: Apr. 13, 2017

(87) PCT Pub. No.: WO2016/058101

PCT Pub. Date: Apr. 21, 2016

(65) Prior Publication Data

US 2017/0234034 A1 Aug. 17, 2017

Related U.S. Application Data

(60) Provisional application No. 62/122,268, filed on Oct. 16, 2014.

(51) Int. Cl.
*E05B 19/04* (2006.01)
*E05B 47/00* (2006.01)

(52) U.S. Cl.
CPC ..... *E05B 19/04* (2013.01); *E05B 47/0045* (2013.01)

(58) Field of Classification Search
CPC ..... E05B 19/04; E05B 47/0045
USPC ..... 70/413, 408
See application file for complete search history.

(56) References Cited

U.S. PATENT DOCUMENTS 1,669,115 A * 5/1928 Anakin ..... E05B 47/0045 70/393
3,239,178 A * 3/1966 Pompa ..... F16B 47/003 211/1
3,566,637 A * 3/1971 Hellmann ..... E05B 47/0044 70/276
3,602,020 A * 8/1971 Kajita ..... E05B 37/00 292/150
3,779,052 A * 12/1973 Deitch ..... E05B 47/0038 200/42.02

(Continued)

FOREIGN PATENT DOCUMENTS

CN 201924670 U 8/2011
CN 203701747 U 7/2014

OTHER PUBLICATIONS

International Search Report and Written Opinion dated Dec. 22, 2015.

*Primary Examiner* — Suzanne L Barrett
(74) *Attorney, Agent, or Firm* — Rowand LLP

(57) ABSTRACT

Magnetic keys, bow caps and key components are described. In one aspect, the present application describes a key. The key includes a blade and a bow connected to the blade. The bow is for applying torque to the blade. The bow defines a key ring aperture located near a top of the bow. The top is the portion of the bow furthest from the blade. The key also include a magnet fixedly coupled to the bow by placement within the key ring aperture to provide a magnetic field on at least one side of the key.

16 Claims, 6 Drawing Sheets

(56) References Cited

U.S. PATENT DOCUMENTS 3,782,147 A * 1/1974 Hallmann ..... E05B 47/0042 70/276
3,967,479 A * 7/1976 Vick ..... E05B 47/0041 200/43.08
3,995,460 A * 12/1976 Sedley ..... E05B 47/0043 70/210
4,022,038 A * 5/1977 Miller ..... E05B 47/0038 70/276
4,285,220 A * 8/1981 Kajita ..... E05B 47/0041 70/276
4,297,569 A 10/1981 Flies
6,164,101 A * 12/2000 Kito ..... B60R 25/24 70/278.3
6,606,767 B2 * 8/2003 Wong ..... A41F 1/006 24/303
7,047,776 B2 * 5/2006 Blake ..... E05B 19/00 70/408
8,915,356 B1 * 12/2014 Cha ..... A45C 11/323 206/37.3
9,784,014 B2 * 10/2017 Meissner ..... E05B 19/0023
2003/0066321 A1 * 4/2003 Su ..... E05B 17/185 70/276
2004/0079125 A1 * 4/2004 Morehart ..... E05B 19/04 70/408
2006/0027003 A1 * 2/2006 Mizukura ..... E05B 17/16 70/252
2006/0032279 A1 * 2/2006 Andersen ..... A45C 11/32 70/395
2012/0055214 A1 * 3/2012 Nickeas ..... E05B 13/101 70/413
2012/0131967 A1 * 5/2012 Sanchez Giraldez ... A41F 1/002 70/276
2014/0230500 A1 * 8/2014 Oliana ..... E05B 15/14 70/344
2016/0369526 A1 * 12/2016 Ho ..... E05B 19/00

* cited by examiner

MAGNETIC KEY ASSEMBLY

RELATED APPLICATION

This application is a United States National Phase Application under 35 U.S.C. 371 of International Application No. PCT/CA2015/051040 filed Oct. 15, 2015 and claims priority to U.S. Provisional Patent Application No. 62/122,268 filed on Oct. 16, 2014, both of which are incorporated herein by reference.

FIELD

The present application relates to keys and, more particularly, to keys, key bows and key caps configured for securing a key to a ferrous surface, such as a metallic object.

BACKGROUND

Keys used for operating locks provide access control to buildings, vehicles, office furniture, cabinets, pad locked premises and so on. Consumers commonly carry a set of keys they need for daily activities. Typically, a key consists of a "blade", which is the portion of the key that slides into the key way of a lock and a "bow", which is the portion of key that is left protruding from the key way so that torque can be applied to the blade.

Consumers often place an extra key in an inconspicuous location within close proximity to the mating lock such that if a primary key is lost, a hidden key may be retrieved to open the lock. In many everyday situations, a key is placed in a concealed location for a family member, friend or even a contractor to access a building or locked chattel. Spare access keys are quite often hung on a nail, placed within a mailbox or under a door mat. These types of hiding locations are obvious to a potential intruder.

Magnetic key cases are known to exist wherein a key may be placed within a case which is then magnetically attached to a ferrous object for future use, if necessary. Such key cases are relatively bulky in relation to the key itself thereby making it rather difficult to successfully conceal in reasonable proximity to the corresponding lock without being detected by unscrupulous persons. A new and improved key device that could be conveniently and stealthily concealed in an unsuspecting and inconspicuous location would be beneficial to most every consumer.

By way of further example, U.S. Patent Publication Number US 2004/0079125, filed Oct. 29, 2002, contemplates a key having a permanent magnet retained within a bow opening by means of an intermediate grommet holder with the bow then encased in plastic. The grommet holder and plastic encasement of the bow makes the device bulky and undesirable for application to common building keys, office furniture keys and the like. Further, the plastic casing, which fully encases the magnet, significantly reduces gauss strength of the magnet. Furthermore, this configuration requires a key blank to be manufactured with a special hole to receive the magnet.

Traditional keys also suffer from disadvantages. For example, since most keys are constructed of a metallic material they tend to create an undesired noise when impacting one another. A plurality of keys mounted to a key ring can be unappealing due to the rattling noise when in motion. Additionally, a bundle of traditional keys that are freely movable on a key ring tend to get tangled with other items within a purse, carry bag, clothing pocket and so on.

Thus, there is a need for improvements in keys that address one or more of the problems described above or the problems that will be apparent to one of skill in the art based on the detailed description contained herein.

BRIEF DESCRIPTION OF THE DRAWINGS

Reference will now be made, by way of example, to the accompanying drawings which show example embodiments of the present application, and in which.

DETAILED DESCRIPTION

In one aspect, the present application describes a key. The key includes a blade and a bow connected to the blade. The bow is for applying torque to the blade. The bow defines a key ring aperture located near a top of the bow. The top is the portion of the bow furthest from the blade. The key also include a magnet fixedly coupled to the bow by placement within the key ring aperture to provide a magnetic field on at least one side of the key.

In another aspect, the present application describes a bow cap for a key. The bow cap includes a body portion defining a bow slot for receiving a bow of a key and a key ring aperture located between the bow slot and a top of the bow cap. The bow cap also includes a magnet fixedly coupled to the body portion by placement within the key ring aperture to provide a magnetic field on at least one side of the key.

In another aspect, a key component is described. The key component includes a bow adapted at one end for connection to a blade of a key. The bow defines a key ring aperture located near a top of the bow. The top is the portion of the bow furthest from the end of the bow that is adapted for connection to a blade of a key. The key component further includes a magnet fixedly coupled to the bow by placement within the key ring aperture to provide a magnetic field on at least one side of the key.

Other aspects and features of the present application will be understood by those of ordinary skill in the art from a review of the following description of examples in conjunction with the accompanying figures.

Figure 1A:
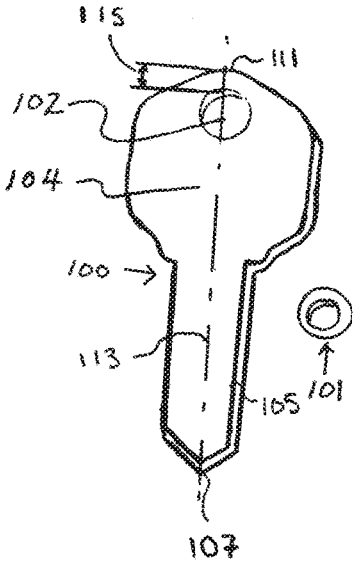
FIG. 1A illustrates a perspective view of a key blank and magnet for use in accordance with embodiments of the present application.

Reference is first made to FIG. 1A which is a perspective view of two key components that, when assembled, form a key assembly 199 (FIG. 1B), which will be referred to herein as a "magnetic key" or a "key" herein. The key components illustrated in FIG. 1A include a key blank 100 and a magnet 101. The key blank includes a blade 105. The blade 105 is the portion of the key blank 100 that slides into the key way of a lock. The blade 105 illustrated in FIG. 1A is an uncut blade, meaning that it has not yet been cut or milled for receipt within a lock. An uncut blade 105 such as the blade illustrated in FIG. 1A, may be adapted to be cut. That is, the blade 105 may be sized and otherwise configured for receipt within a key cutting or milling machine. While the blade 105 illustrated in FIG. 1A is uncut, in other embodiments the blade 105 could be cut for receipt within a mated key way of a lock. This application is, therefore, intended to apply to both cut and uncut keys.

The blade 105 is connected to a bow 104 for applying torque to the blade 105. In the example illustrated, the blade 105 and the bow 104 are integrally formed. However, as will be described below, in some embodiments, the blade 105 may be coupled to the bow 104 using other techniques. The bow 104 is the portion of the key blank 100 that is designed to be left protruding from a key way so that torque can be applied to the blade 105. The portion of the bow 104 that connects to the blade 105 will be referred to herein as the bottom of the bow 104. The bottom of the bow 104 is, for the purposes of this disclosure, the portion of the bow 104 that is closest to the blade 105 and the top 111 of the bow 104 is the portion of the bow 104 that is furthest from the blade 105. A tip 107 of the blade 105 is defined, for the purposes of this disclosure to be the portion of the blade 105 that is furthest from the bow 104. The tip 107 of the blade is the portion of the blade that is first inserted into a key way of a lock when the key is inserted into the key way. The top 111 of the bow 104 is also, for the purposes of this disclosure, considered the top of the key blank and the tip 107 of the blade 105 is also, for the purposes of this disclosure, considered to be the tip of the key blank 100 and also the bottom of the key blank.

Using these definitions, the top 111 of the bow 104 is above the tip 107 and both the top 111 of the bow 104 and the tip 107 of the key blank are substantially located along a line 113 that bisects the key into two parts. This line 113 bisects the bow 104 into two equal parts. Note that in other embodiments, the bow 104 may not be symmetrical.

A key ring aperture 102 is defined by the bow 104. The key ring aperture 102 is located near an end of the bow 104 and, more particularly, near the top 111 of the bow 104. The key ring aperture 102 is the portion of the bow that is, on traditional keys, configured to receive a key ring. The key ring aperture 102 is sufficiently close to a side of the bow 104 to permit a key ring to be easily received in the key ring aperture 102. For example, in at least some embodiments, the key ring aperture 102 is located on the bow 104 such that a gap 115 between the side of the bow 104 and a nearest edge of the key ring aperture 102 is four millimeters or less. More specifically, the distance between the top 111 of the bow 104 and the key ring aperture 102 is four (4) millimeters or less. In the example, the key ring aperture 102 is centered on the line 113.

Some key blanks may have key ring apertures that have a gap 115 of more than four (4) millimeters. However, as the gap 115 increases in size, the difficulty of attaching the key blank to a key ring also increases.

The key ring aperture 102 of FIG. 1A is circular, having a diameter of ten (10) millimeters or less. The key ring aperture 102 may have other configurations in other embodiments.

Figure 1B:
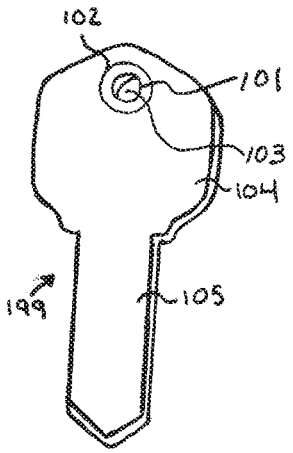
FIG. 1B illustrates a perspective view of a key assembly including the key blank and magnet of FIG. 1A.

The components illustrated in FIG. 1A also include a magnet 101 which cooperates with the key blank 100 to form the key assembly 199 (FIG. 1B). As illustrated in FIG. 1B, the magnet 101 is fixedly coupled to the bow 104 by placement within the key ring aperture 102. In some embodiments, an interference fit, also known as a press fit or friction fit, is utilized to fasten the magnet 101 within the key ring aperture 102. In such embodiments, the magnet 101 may be nominally greater in outside diameter to that of the key ring aperture 102 so that when the magnet 101 is pressed into the key ring aperture 102, the two parts interfere with each other's occupation of space resulting in both parts slightly deforming to fit together creating friction between the parts so that they are locked together and cannot move relative to each other. The tightness of fit is controlled by the amount of interference (known as allowance) which has minimum and maximum tolerances. For example, the magnet 101 may have an outside diameter of 7.500 millimeters while the key ring aperture 102 may have a diameter of 7.499 millimeters. By way of further example, in one embodiment, the magnet 101 may have an outside diameter of 0.3930 inches whereas the key ring aperture 102 may have a diameter of 0.3920 inches.

Other methods of attaching the magnet 101 within the key ring aperture 102 may be used in other embodiments. For example, the magnet 101 may be attached using an adhesive, a weld, an ultrasonic weld, or another attachment method. By utilizing the key ring aperture 102 for magnet 101 placement, the embodiment of FIGS. 1A and 1B may reduce manufacturing costs from those incurred for embodiments in which the magnet is placed in other locations since existing tooling for key blanks are already configured to create the key ring aperture 102 in this location. Furthermore, such magnet placement does not comprise space on the bow that is often used for advertising manufacturer name, key reference number, country of origin and so on. Also, by locating the magnet in this position, when a magnetic key is attached to an adjacent magnetic key or set of keys, a selected key can be pivotally rotated away from the other of the keys yet still be magnetically attached to an adjacent key(s). This allows a substantial portion of the key bow of the key to be exposed for hand gripping. In at least some embodiments, this allows the magnetic key to be used for insertion within the key way of a lock while remaining attached to other keys with the magnet 101. In this embodiment, there is no degradation to the dimensions of the magnetic key in comparison to a conventional metal key blank.

In the embodiment of FIGS. 1A and 1B, the magnet 101 is a ring magnet that defines a hole 103 there through which permits a key ring (not shown) to be received when the magnet 101 is located within the key ring aperture 102. The ring magnet enables the key assembly 199 to be mounted to a common key ring should it be desired. That is, the hole 103 allows the key ring aperture 102 to continue to function as a key ring aperture when the magnet 101 is installed into the key ring aperture 102 since the hole 103 acts as a key ring aperture permitting the key ring to be received. By using a ring magnet in the key ring aperture 102, the magnetic key can be easily rotated when the magnetic key is attached to a key ring or similar device.

The hole 103 provided by the ring magnet 101 is sufficiently large to permit a key ring to be received within the hole 103. In at least some embodiments, the hole 103 has a diameter of at least 3.5 millimeters or more.

As noted above, the key assembly 199 may be connected to an adjacent key, which may be another magnetic key. The key assembly 199 of FIG. 1B can be detachably connected to any magnetic responsive metal surface without concern for gravitational force. Some examples of locations for concealing the key assembly 199 include the underside of a steel mail box, a side panel of steel office furniture, underside of a vehicle and so on. Alternatively, the key assembly 199 may be conspicuously attached to a magnetic responsive object such as a refrigerator so as not to misplace it.

Figure 1C:
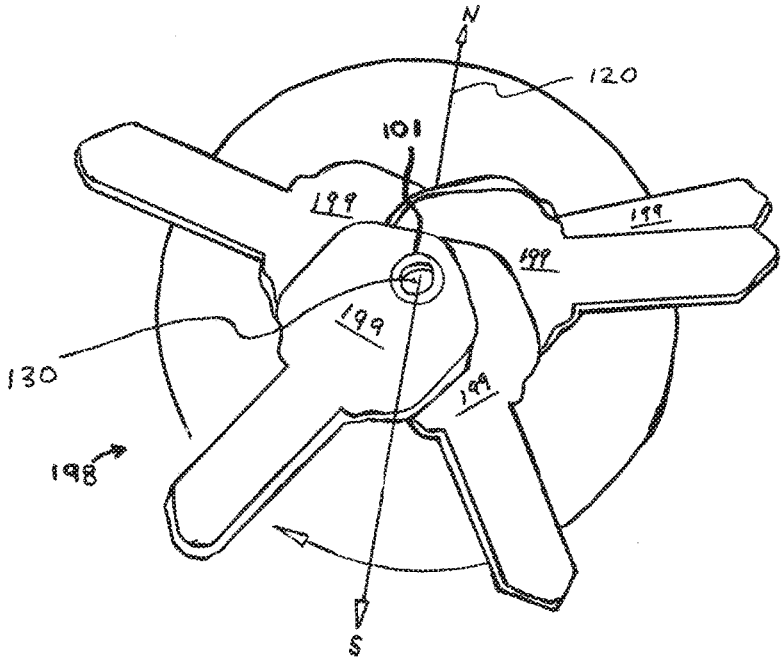
FIG. 1C is a perspective view of a set of magnetic key assemblies in accordance with example embodiments of the present application.

Referring now to FIG. 1C, an example set 198 of key assemblies 199 are illustrated. In the example, the set 198 includes five magnetic keys. The keys are coupled to one another with their respective magnets 101. The key assemblies 199 cooperates with each other for attraction of one key assembly 199 to the next. In the example, the keys are interconnected solely by magnetic interaction. More particularly, in the example of FIG. 1C, the keys are connected together without the use of a key ring. Each magnet 101 is arranged to provide a magnetic field on at least one side of the key, which is used to couple the key to an adjacent key.

In the example of FIG. 1C, each magnet provides a magnetic field on both sides of the key. However, the polarity associated with the magnetic field on each side is different. The north N and south S magnetic poles are orientated for attraction of one key assembly 199 to an adjacent key assembly. That is, the south pole of the magnet is oriented to provide a magnetic field at a first side of the key (e.g., a first planar side of the key) while the north pole is oriented to provide a magnetic field at a second side of the key (e.g., a second planar side of the key). The second side of the key is opposite the first side of the key.

Figure 1D:
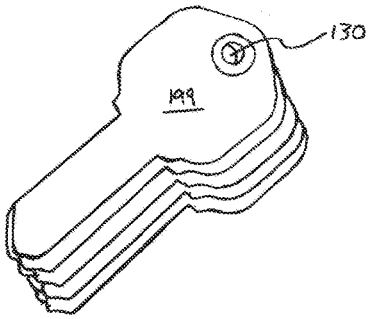
FIG. 1D is a perspective view of a stacked set of magnetic key assemblies in accordance with example embodiments of the present application.

This configuration of the magnet ensures alignment of the keys along an axis 120, thereby providing the convenience of interconnection which eliminates rattling and allows for the set 198 to be pivotally manipulated into one congruent stack, which is illustrated, for example, in FIG. 1D. Individual key assemblies 199 can be easily rotated in relation to one another at the magnetic pivot point 130 to obtain a desired key assembly 199 for insertion into a key way.

Figure 1E:
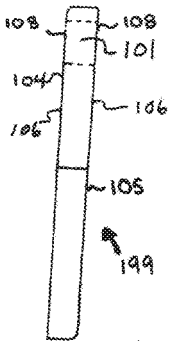
FIG. 1E is a side view of the magnetic key assembly of FIG. 1B.

Referring now to FIG. 1E, a side view of a key assembly 199 is illustrated. As illustrated in FIG. 1E, the thickness of the magnet 101 may, in at least some embodiments, correspond to the thickness of the bow 104. For example, in some embodiments, the thickness of the magnet 101 may be the approximately the same as the thickness of the bow 104 (e.g., within 5%) so that the exposed ends 108 of the magnet align with planar surfaces 106 of the bow 104 and blade 105. That is, the exposed ends 108 are relatively flush with the bow 104. In at least some embodiments, the magnet 101 is at least as thick as the bow 104. For example, in some embodiments, the magnet 101 may protrude beyond first and second planar surfaces 106 of the key bow 104 by a predetermined amount (e.g. 12 percent per planar side of the key blank thickness) to keep planar surfaces of magnetically interconnected key assemblies 199 from rubbing against each other By way of example, in some embodiments, the magnet 101 may protrude from each end by 0.2 to 0.4 mm. Such a nominal protrusion of the magnet from each planar surface 106 of the bow 104 would ensure that friction between magnetically interconnected keys is eliminated when pivoted in relation to each other as illustrated in FIG. 1C, yet the spacing between keys would be virtually unnoticeable to the consumer.

Figure 1F:
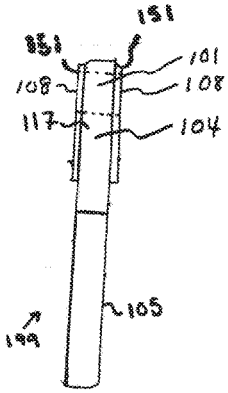
FIG. 1F is a side view of a further example magnetic key assembly in accordance with example embodiments of the present application.

In the example of FIG. 1E, the bow 104 is a one-piece bow 104 which may, for example, be constructed of a metal. Referring now to FIG. 1F, in other embodiments, the bow 104 may be a multi-piece bow. The bow 104 of FIG. 1F includes a polymer portion 151 which coats a metallic portion 117 of the bow 104. The polymer portion 151 may be a plastic, rubber, or silicone coating that is applied to the metallic portion 117 of the bow 104. In this embodiment, the magnet 101 may be sized based on total thickness of the bow 104, which includes both the thickness of the polymer portion 151 and the metallic portion 117. The exposed ends 108 of the magnet 101 are relatively flush with the polymer portion 151.

Figure 1G:
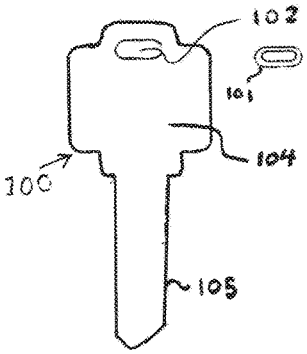
FIG. 1G is a front view of a key blank and magnet for use in accordance with example embodiments of the present application.

While the key ring aperture 102 in the embodiments of FIGS. 1A to 1F are illustrated as circular and the magnet 101 is also illustrated as circular, in other embodiments, the key ring aperture 102 and the magnet 101 may have other shapes. For example, referring now to FIG. 1G, in one embodiment, an oval magnet 101, such as an oval ring magnet, may cooperate with an ovular key ring aperture 102. Other variations in shape of the magnet and the key ring aperture are possible. In such embodiments, the shape of the magnet generally corresponds to the shape of the key ring aperture 102.

Furthermore, while the embodiments of FIGS. 1A to 1G illustrate a magnet 101 having a hole 103 there through, in other embodiments, the magnet 101 may not have a hole. For example, in some embodiments, the magnet 101 is a disk magnet. Where a disk magnet is inserted within the key ring aperture 102, the key may no longer receive a key ring. For some uses (e.g., if the key is simply a spare key that is concealed in a given location), this reduction in capability may be acceptable. Further, a key of this type could be used with other similar magnetic keys to form a set 198 without the need for a key ring, as discussed above with reference to FIG. 1C. The disk magnet may be used to increase the magnetic strength of the key assembly when compared with that of the ring magnet.

Figure 2A:
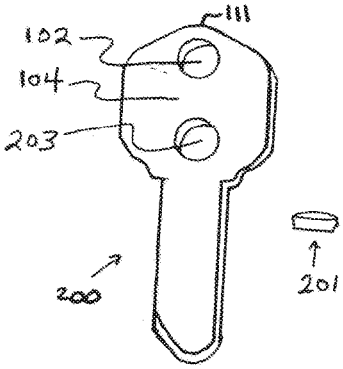
FIG. 2A is a perspective view of a further example key blank and magnet for use in accordance with example embodiments of the present application.
Figure 2B:
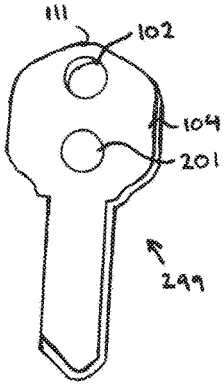
FIG. 2B is a perspective view of a magnetic key assembly including the key blank and magnet of FIG. 2A.

However, in some embodiments, to permit a disk magnet to be used while still allowing a key ring to be received in the key, a disk magnet 201 may be inserted within a separate aperture 203 defined by the bow 104. Referring now to FIGS. 2A and 2B, one such example will be discussed. FIG. 2A illustrates a perspective view of two key components that, when assembled, form a key assembly 299, which is illustrated in FIG. 2B.

The key components include a key blank 200 and a disk magnet 201. The key blank 200 includes a bow 104 defining two apertures—a key ring aperture 102 and a separate aperture 203 for receiving the magnet 201. The separate aperture 203 is further from the top of the key than the key ring aperture 102 and is more centrally located on the bow 104 than the key ring aperture 102. By way of example, in some embodiments, the separate aperture 203 may be ten (10 mm) or more away from the top 111 of the bow 104.

The disk magnet 201 has two parallel surfaces and when the disk magnet is inserted within the separate aperture 203, these surfaces may be substantially flush with planar surfaces of the bow 104. Attachment of the magnet to the bow may be achieved with any one of the attachment methods noted above.

Figure 3A:
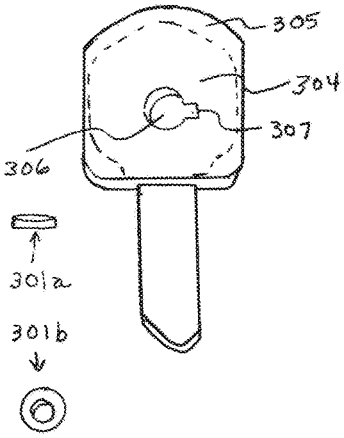
FIG. 3A is a perspective view of a further example key blank and magnets for use in accordance with example embodiments of the present application.
Figure 3B:
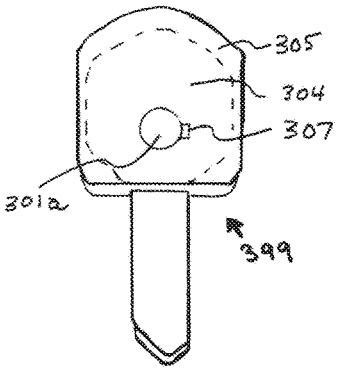
FIG. 3B is a perspective view of a magnetic key assembly including the key blank and magnet of FIG. 3A.
Figure 3C:
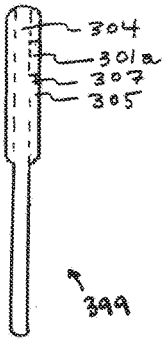
FIG. 3C is a side view of the example magnetic key assembly of FIG. 3B.

Referring now to FIGS. 3A, 3B and 3C, a further embodiment is illustrated. FIG. 3A illustrates components that may be used to form a key assembly 399, which is illustrated in perspective view in FIG. 3B and in a side view in FIG. 3C.

In this example, a bow 304 is a plastic, rubber or silicone coated bow 304. That is, a coating 305 is applied to a metallic portion of the bow 304 (or a portion of the bow that is constructed of a different material) and effectively encapsulates the metallic portion of the bow 304. The coating 305 defines a cavity 306 which is configured to receive a magnet 301*a*, 301*b*. Typically, the magnet 301*a* is a disk magnet in this configuration, but the magnet could take other forms, including a ring magnet 301*b*.

In this embodiment, the magnet 301*a*, 301*b* does not extend through the entirety of the bow 304. Rather, as illustrated in FIG. 3B, the magnet 301*a*, 301*b* is received in the cavity and is generally at one side of the bow 304. In the example, the cavity 306 is formed within the coating 305 and the metallic portion of the bow 104 acts as a base of the cavity, however in other embodiments, the magnet 301*a*, 301*b* could extend into the planar surface of the metallic bow 304. The magnet may be attached within the cavity by any one of a number of suitable techniques including, for example, an adhesive, friction or interference fit, a molding process, etc. In the embodiment of FIGS. 3A to 3C, the magnet 301*a*, 301*b* is configured to be removable. In the example, a slot 307 is interconnected to the cavity and allows a friction-fitted magnet to be removed with a prying instrument such as a screwdriver, paperclip, pen, etc.

The magnet 301*a* may have a thickness defined by the thickness of the cavity so that when the magnet 301*a* is inserted within the cavity 306, an outer surface of the magnet is substantially flush with an exposed surface of the bow 304.

While a side view shown in FIG. 3C only illustrates a single magnet 301*a*, 301*b*, multiple magnets could be used so that a magnetic field is provided at both sides of the bow 304.

Figure 4A:
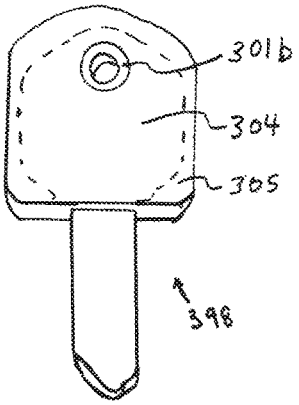
FIG. 4A is a further example magnetic key assembly in accordance with embodiments of the present application.
Figure 4B:
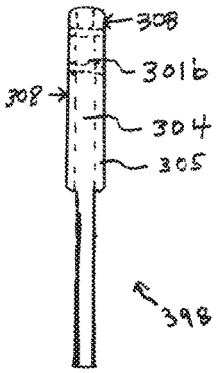
FIG. 4B is a side view of the magnetic key assembly of FIG. 4A.

A key having an encased bow 304 of the type described in FIGS. 3A to 3C could also be used with features similar to those discussed in FIGS. 1A to 1G. Referring now to FIGS. 4A and 4B, one such example key assembly 398 is illustrated. In the example illustrated, the bow 304 includes the coating 305 which encases a metallic portion of the bow. A ring magnet 301*b* is inserted within the key ring aperture. The key ring aperture is generally located as described above with reference to FIGS. 1A to 1G.

In some such embodiments, the magnet 301*b* may not interfere with the metallic portion of the bow 304. Instead, the magnet 301*b* may contact the coating 305 and may be held in place through contact with the coating 305. As discussed above with reference to FIGS. 1E and 1F, the magnet 301*b* may be of a thickness that substantially corresponds with the thickness of the bow 304 (including both the metallic portion and the coating 305). Surfaces of the magnet 301*b* that are exposed from the key assembly 398 may be substantially flush with planar surfaces 308 of the bow 304.

Referring now to FIGS. 5A to 5D, a further example embodiment of a key assembly 499 is illustrated. The components of the key assembly are shown separated from one another in FIG. 5A. These components include a magnet 401, a blade 425, and a bow 404. The magnet 401 may be of the type described above and is, in the example, a ring magnet. In the example illustrated, the ring magnet is inserted within a key ring aperture 402 defined by the bow 404.

The blade 425 may, for example, be formed from brass or aluminum. The bow 404 is formed of a polymer, rubber, or silicone material. The bow 404 defines a slot 430 which receives the blade 425. More particularly, the blade 425 is inserted within the slot 430 through an open end 410 of the slot 430. The blade 425 may be snap fitted or friction fitted within the bow 404. Other methods of attachment may be used in other embodiments. For example, an interlocking mechanism (not shown) could secure the blade 425 to the bow 404.

Figure 5A:
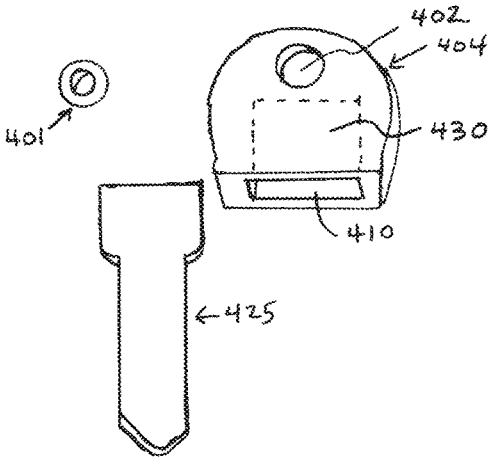
FIG. 5A is a perspective view of a magnet, bow and blade for use in accordance with example embodiments of the present application.
Figure 5B:
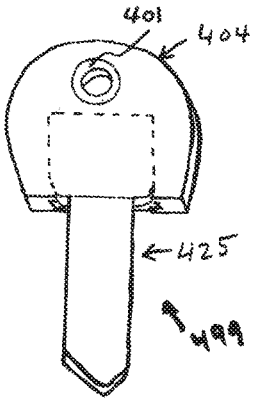
FIG. 5B is a perspective view of a magnetic key assembly including the magnet, bow and blade of FIG. 5A.
Figure 5C:
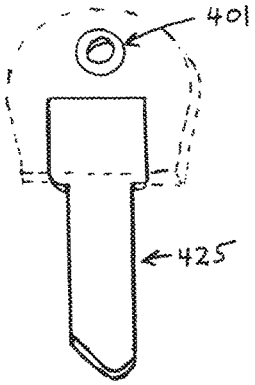
FIG. 5C is a perspective view of a magnet and blade in accordance with example embodiments of the present application.

Referring to FIG. 5C, in some embodiments, the key assembly 499 may be formed by positioning the blade 425 and the magnet 401 in a fixture and molding the bow 404 around the blade 425 and the magnet 401. Accordingly, the bow 404 may, in at least some embodiments, be injection molded.

Figure 5D:
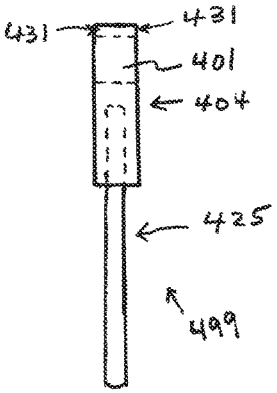
FIG. 5D is a side view of the magnetic key assembly of FIG. 5B.

Referring to FIG. 5D, which is a side view of the key assembly 499, the magnet 401 may be sized to have a thickness similar to that of the bow 404 so that the magnet 401 is flush with the planar walls 431 of the bow 404.

Figure 5E:
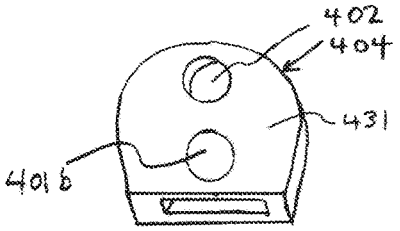
FIG. 5E is a perspective view of a bow in accordance with example embodiments of the present application.

FIG. 5E illustrates as alternative bow 404 configuration. The bow 404 of FIG. 5E may be used in place of the bow illustrated in FIGS. 5A to 5D. The bow 404 of FIG. 5E differs from the bow in FIGS. 5A to 5D in that the magnet

401*b* is not located in the key ring aperture 402 in the embodiment of FIG. 5E. Instead, a separate aperture or cavity is provided in the bow 404. This separate aperture or cavity may, for example, have the characteristics of the apertures 203 described above with reference to FIGS. 2A-2A or the cavities 306 described with reference to FIGS. 3A to 3C 3A-3C. In one example, a disk magnet 401*b* is inserted within at least one planar wall 431 of the bow below the key ring aperture 402. The disk magnet 401*b* may be secured in a cavity of the bow 404 through an injection molding process, for example. In another embodiment, the disk magnet 401*b* is attached to a bow sidewall using an adhesive or welding technique. In the embodiment illustrated, the disk magnet is circular. However, the disk magnet could alternatively be in the form of a rectangular or square bar magnet.

Figure 6A:
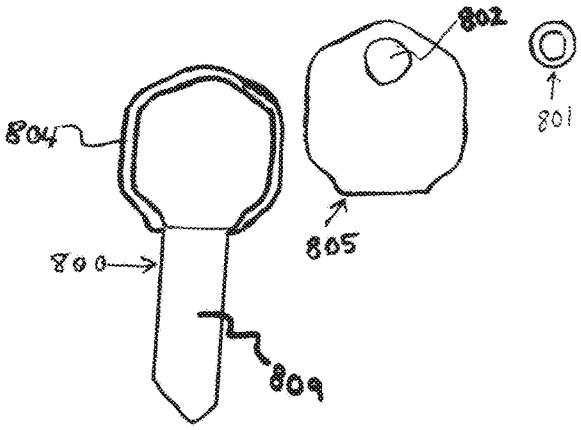
FIG. 6A is a front view of components of a magnetic key assembly in accordance with example embodiments of the present application.
Figure 6B:
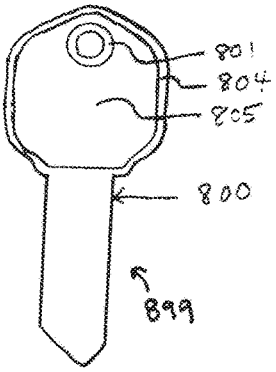
FIG. 6B is a front view of a magnetic key assembly that includes the components of FIG. 6A.

FIGS. 6A and 6B illustrate a further example embodiment of a key assembly 899. The key assembly 899 includes a key blank 800 that includes a blade 809 and, at least a portion of the bow 804. More particularly, the blade 809 is coupled to a ring-like portion of the bow 804. The ring-like portion of the bow forms a frame which receives a bow insert 805. As illustrated in FIG. 6B, the bow insert 805 is provided within the ring-like portion to fully form the bow 804. The bow insert 805 may be provided in the ring-like portion by injection molding, over molding or other means. The bow insert may, for example, be formed from plastic or another suitable material. The bow insert includes an aperture which receives the magnet 801. The aperture is, in the example, a key ring aperture 802 that is situated on the bow 804 (and, more particularly, on the bow insert 805) at a position which would allow it to conventionally receive a key ring. However, in other embodiments, a separate aperture apart from the key ring aperture could be used. In the embodiment illustrated, the magnet 801 is a ring magnet. In other embodiments, such as those in which a separate aperture is provided on the bow 804 apart from the key ring aperture 802, a disk magnet or other suitable geometric shape could be used instead of the ring magnet.

Key assemblies having the magnetic bow described herein may, for example, be keys in the traditional sense. That is, the keys may be cut or adapted to be cut so that they can be received within a key way of a lock. The magnetic features may also be used for other non-traditional keys. For example, in some embodiments, the techniques described herein may be used with a data key, which may also be referred to as a data storage key. A data key is a key in which the key includes a computer readable memory for data storage, data retrieval and the like. The computer readable memory may be encased on the bow, the blade, or both. In a data storage key, the blade is configured for receipt within an interface provided on an electronic device which allows the computer readable memory to be accessed by the electronic device. The data storage key may, for example, be a Universal Serial Bus ("USB") key. Examples of such data keys are illustrated in FIGS. 7A to 7C.

Figure 7A:
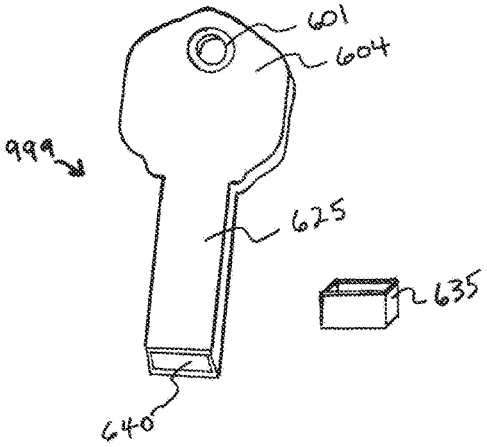
FIG. 7A is a perspective view of an example magnetic key assembly that is a data key, in accordance with example embodiments of the present application.
Figure 7B:
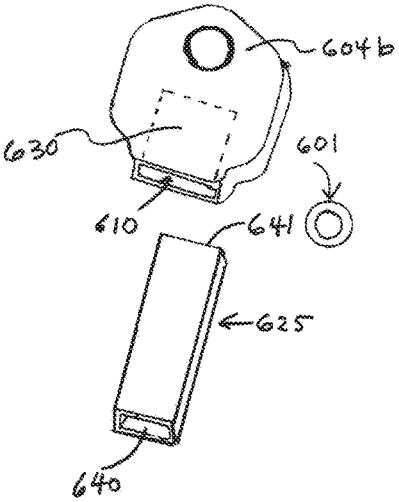
FIG. 7B is a perspective view of an example magnetic key assembly that is a data key, in accordance with example embodiments of the present application.
Figure 7C:
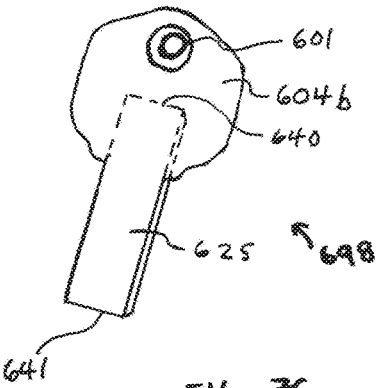
FIG. 7C is a perspective view of the magnetic key assembly of FIG. 7B showing a blade inserted within a bow.

Referring now to FIG. 7A, an example key assembly 999 for a data storage key is illustrated. The key assembly include a bow 604 and a blade 625. In the example illustrated, the bow 604 has a form factor resembling that of a bow for a traditional key. The key assembly includes a computer readable memory encased within the bow 604, the blade 625 or both. The computer readable memory may be flash memory, for example. The memory is housed within the key assembly and may be accessed through an interface 640 provided at or near the tip of the blade 625. The interface may include a plurality of pads or pins that connect with other pads or pins when the key assembly 999 is inserted within a mated interface, such as a port, on an electronic device. The memory may, for example, be provided on a printed circuit board (PCB) on which the pads or pins are provided. In the example illustrated, the interface 640 is a USB plug. The USB plug may, for example, be a micro USB plug or a standard USB plug.

The key assembly 999 of FIG. 7A may be substantially constructed of a metal or plastic material. For example, a housing that houses the internal components of the data key may be plastic or metal. The key assembly 999 includes a cover 635 which, in the example, is magnetically attachable.

The key assembly 999 of FIG. 7A includes a magnet 601 mounted in a key ring aperture defined by the bow. The key ring aperture is positioned on the key assembly at a location similar to that described above with reference to FIGS. 1A to 1G. For example, it is located near the top of the bow 604. In at least some embodiments, the key ring aperture is located on the bow 604 such that a gap between a side of the bow 604 (such as the top of the bow) and a nearest edge of the key ring aperture is four millimeters or less. More specifically, the distance between the top of the bow 604 and the key ring aperture is four (4) millimeters or less. The key ring aperture is located to allow for easy receipt of a key ring.

The magnet 601 is inserted within the key ring aperture and is, in the example, a ring magnet, allowing the key assembly to be placed on a key ring. Alternatively, the ring magnet 601 could be installed within a clamshell type body of the key assembly 999 so that the ring magnet 601 surrounded a key ring aperture on the bow 604 yet the ring magnet 601 is not externally visible.

Different data key assemblies can be provided apart from that of FIG. 7A. For example, referring to FIGS. 7B and 7C, a further example key assembly 698 is illustrated. Unassembled components of the key assembly are illustrated in FIG. 7B and assembled components are illustrated in FIG. 7C. Many features of the key assembly 698 of FIGS. 7B and 7C are similar to those of the key assembly 999 of FIG. 7A and the discussion of such features will not be repeated.

In the key assembly 698 of FIGS. 7B and 7C, a magnet 601 is inserted within a key ring aperture provided on a bow 604*b*. The thickness of the magnet 601 may correspond with the thickness of the bow 604*b*.

The bow 604*b* is formed from a metal or plastic material and provides an internal slot 630 accessible through a bottom edge 610 of the bow 604*b* for accommodating a blade 625. The blade 625 is friction or snap fit within the slot 630 and is removable from the slot so that the interface 640 may be installed into an accommodating interface located on a computing device, smartphone, and so on. Either end 640, 641 of the blade 625 may be inserted within the slot 630. In some embodiments, each end may have a different interface provided thereon. For example, a first end may have a standard USB interface while the second end may have a micro USB interface.

Figure 7D:
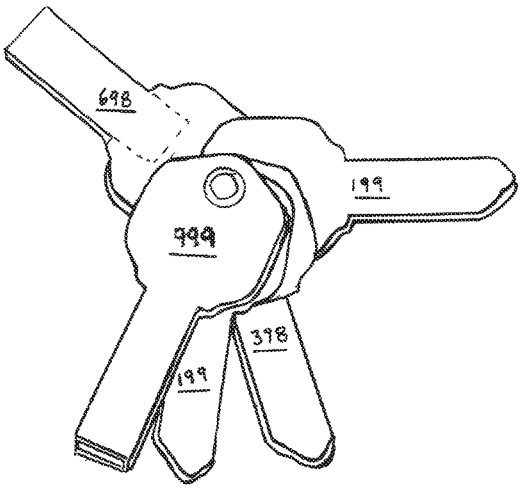
FIG. 7D is a perspective view of a set of magnetic key assemblies in accordance with example embodiments of the present application.

As illustrated in FIG. 7D, the magnetic data key assemblies 698, 999 may be connected to other magnetic data key assemblies 698, 999 and/or other magnetic key assemblies 199, 398, using the magnets.

While FIGS. 7A to 7D generally refer to embodiments of a data key assembly that resembles a traditional key, in other embodiments, the data key assembly may take other forms. For example, in some embodiments, magnetic features described herein may be used with other data key assemblies having different form factors. For example, such data key assemblies may not have a distinct bow and blade. Some such data keys may include a housing that houses the electrical components of the data key assembly; for example, the computer, readable memory. The housing may define an aperture or cavity that receives a magnet. In at least some embodiments, the aperture may be a key ring aperture that is provided at a portion of the housing that is accessible by a key ring. For example, the key ring aperture may be within four millimeters of a side of the data key assembly. In some embodiments, the key ring aperture includes a magnet that defines a hole there through, such as a ring magnet.

Figure 8:
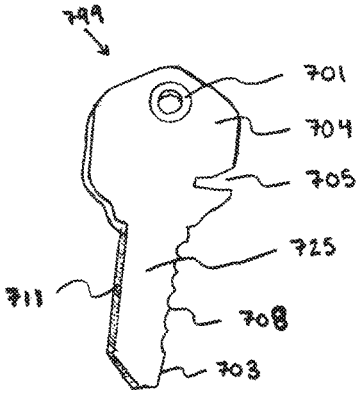
FIG. 8 is a perspective view of a key assembly that includes a plurality of tools in accordance with example embodiments of the present application.

Referring now to FIG. 8, a further magnetic key assembly 799 is illustrated. The key assembly 799 is a multi-tool which has a blade 725 that provides a multiplicity of functions. More particularly, the blade 725 and/or the bow 704 includes at least one tool. The tool may be used for opening packages, removing a staple, tightening a screw, and so on.

The key assembly 799 includes a bow 704 and a blade 725 coupled to the bow. In the example illustrated, the blade 725 includes a knife edge 703, a serrated edge 708, and a file 711. In the example, a pry 705 is also provided on the bow.

The key assembly 799 substantially resembles a traditional key but includes one or more tools. The tools may, in various embodiments, include one or more of: a knife, a file such as a nail file, a saw, a screwdriver, a can opener, a light, such as an LED light, a corkscrew, a reamer, a window or glass breaker, scissors, a stylus, a writing instrument (e.g., a pen, pencil, highlighter, etc.) and pliers.

The key assembly 799 includes a magnet mounted in a key ring aperture defined by the bow 704. The key ring aperture is positioned on the key assembly at a location similar to that described above with reference to FIGS. 1A to 1G. For example, it is located near the top of the bow 704. In at least some embodiments, the key ring aperture is located on the bow 704 such that a gap between the side of the bow 704 and a nearest edge of the key ring aperture is four millimeters or less. More specifically, the distance between the top of the bow 704 and the key ring aperture is four (4) millimeters or less. The key ring aperture is located to allow for easy receipt of a key ring, should it be desired.

The magnet 701 is inserted within the key ring aperture (and is fixedly connected to the bow 704) and is, in the example, a ring magnet, allowing the multi-tool key assembly 799 to be placed on a key ring or interconnected with other magnetic keys.

While FIG. 8 generally refer to embodiments of a tool that resembles a traditional key, in other embodiments, the tool may take other forms. For example, in some embodiments, magnetic features described herein may be used with other tools having different form factors. For example, such tools may not have a distinct bow and blade. Some such tools include a body portion that defines an aperture or cavity that receives a magnet. In at least some embodiments, the aperture may be a key ring aperture that is provided at a portion of the tool that is accessible by a key ring. For example, the key ring aperture may be within four millimeters of a side of the tool. In some embodiments, the key ring aperture includes a magnet that defines a hole there through, such as a ring magnet.

Figure 9A:
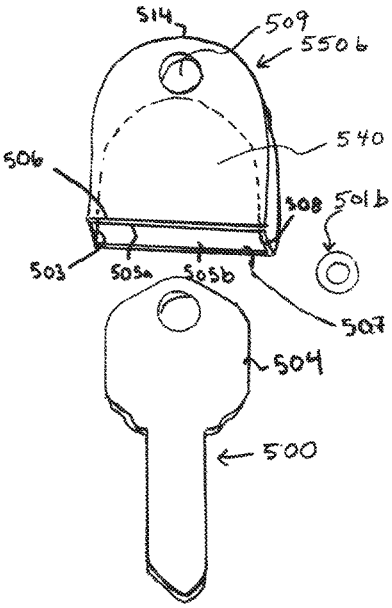
FIG. 9A is a perspective view of an example bow cap and key in accordance with example embodiments of the present application.
Figure 9B:
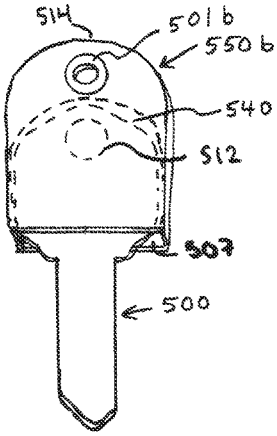
FIG. 9B is a perspective view of the example bow cap of FIG. 9A illustrating the key bow inserted into the bow cap.

In some instances, a user may wish to retro-fit existing keys with magnetic features of the type described herein. Referring now to FIGS. 9A and 9B, a bow cap 550*b* may be used to retro-fit a key. More particularly, the bow cap 550*b* includes a body portion which may be constructed of polyvinyl chloride (PVC), thermoplastic resin, rubber, silicon rubber or a combination of materials including a magnetic resin. The body portion of the bow cap 550*b* defines a bow slot 540 for receiving a key. The bow slot 540 is provided between the two external walls of the bow cap. The bow slot includes a first planar wall 505*a* and a second planar wall 505*b*. The first planar wall 505*a* and the second planar wall 505*b* are joined by a first side wall 508 and a second side wall 503. A top wall (not shown) may connect to the first planar wall 505*a*, the second planar wall 505*b*, the first side wall 508 and the second side wall 503.

The bow slot 540 is sized to securely accommodate a key 500. The key 500 may be inserted within the bow slot 540 through an opening 507, located at the bottom of the bow cap 550*b*. When the key 500 is inserted in the bow cap 550*b*, the bow 504 of the key is located within the bow slot 540 and the blade of the key protrudes through the opening 507.

In some embodiments, the bow slot 540 is configured to accommodate a range of key bow configurations (i.e., different shapes or sizes). Such "universal" functionality is, in at least some embodiments, provided by using a highly-elastic material for the body portion of the bow cap 550*b*.

In some embodiments, the bow cap includes a reinforced rim 506 on a bottom outer edge for improved rigidity of the planar walls 505*a*, 505*b* and the side walls 503, 508.

The body portion of the bow cap may be constructed of an elastic material to provide a solid friction fit between the key 500 and the bow cap 550*b* (and, in some embodiments, to accommodate a range of keys having different bow shapes and sizes). Once the key 500 is inserted within the bow cap 550*b*, the friction fit makes removal of the key 500 difficult so that it will not unintentionally dislodge therefrom.

The bow cap 550*b* also defines a key ring aperture 509 which is circular in the example of FIGS. 9A and 9B. The key ring aperture 509 is located away from the bow slot 540. That is, the key ring aperture 509 is located in a portion of the bow cap 550*b* that is between the top end 514 of the bow cap 550*b* and the bow slot 540. The key ring aperture 509 provided in the bow cap 550*b* does not align with the key ring aperture 512 of the key 500 inserted in the bow slot 540. Rather, the key ring aperture 509 provided in the bow cap 550*b* creates a new key ring aperture for the key 500 when the key is inserted in the bow slot 540. This key ring aperture 509 is located to allow a key ring to be received. More specifically, the key ring aperture 509 is located on the bow cap 550*b* such that a gap between the side of the bow cap 550*b* and a nearest edge of the key ring aperture is four millimeters or less. More specifically, the distance between the top end 514 of the bow cap 550*b* and the key ring aperture is four (4) millimeters or less.

The bow cap 550*b* includes a magnet 501*b* mounted in the key ring aperture 509. The magnet is fixedly coupled to the body portion of the bow cap by placement within the key ring aperture to provide a magnetic field on at least one side of the key. The magnet 501*b* is inserted within the key ring aperture and is, in the example, a ring magnet, allowing the bow cap 550*b* (and a key that has been inserted within the bow cap 550*b*) to be placed on a key ring. Alternatively, the magnet could be installed in the bow cap by means of an injection mold process rather than inserted within an existing key ring aperture.

In the example illustrated in FIGS. 9A and 9B, the magnet is a ring magnet that is received within a circular key ring aperture. However, the magnet could have a different configuration in other embodiments. For example, the magnet may be a disk magnet in some embodiments. In other embodiments, the magnet may be ovular and may be received in an ovular key ring aperture.

The magnet may be oriented to provide magnetic fields on both sides of the bow cap. However, the polarity associated with the magnetic field on each side is different. The north N and south S magnetic poles are orientated for attraction of bow cap to an adjacent key assembly or bow cap. That is, the south pole of the magnet is oriented to provide a magnetic field at a first side of the bow cap while the north pole is oriented to provide a magnetic field at a second side of the bow cap. The second side of the bow cap is opposite the first side of the bow cap.

Figure 9C:
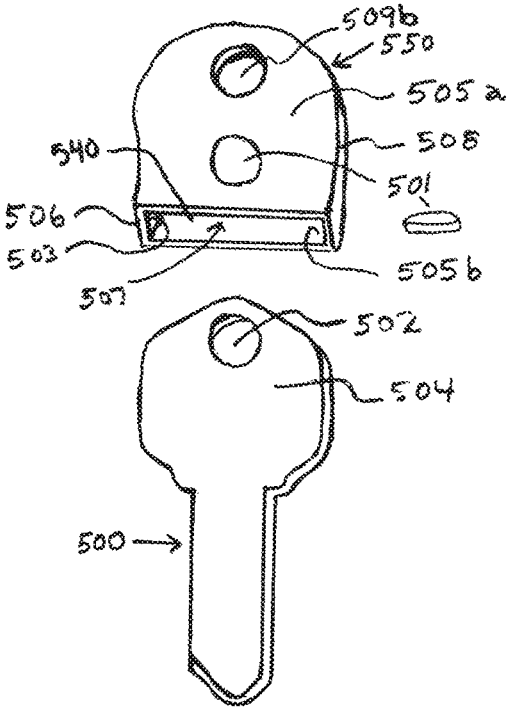
FIG. 9C is a perspective view of a further example bow cap and key in accordance with example embodiments of the present application.
Figure 9D:
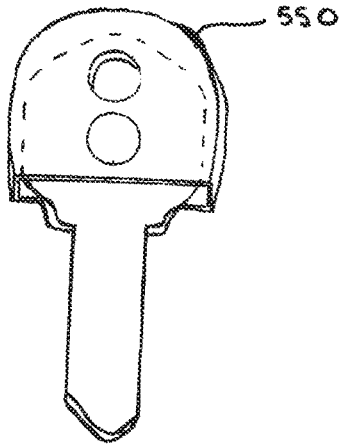
FIG. 9D is a perspective view of the example bow cap of FIG. 9B illustrating the key bow inserted into the bow cap

Referring now to FIGS. 9C and 9D, an alternative bow cap 550 will now be described. The bow cap 550 of FIGS. 9C and 9D includes many features in common with the bow cap of FIGS. 9A and 9B. These discussion of these features will not be repeated at length. For example, the bow cap 550 includes a body portion defining a bow slot 540. The bow slot 540 may be of the type described with reference to FIGS. 9A and 9B. The bow cap 550 of FIGS. 9C and 9D includes a key ring aperture 509*b* similar to the key ring aperture of FIGS. 9A and 9B. However, in the embodiment of FIGS. 9C and 9D, the key ring aperture 509*b* is aligned with the bow slot 540. More specifically, the key ring aperture 509*b* of the bow cap aligns with a key ring aperture 502 of a key 500 when the key is inserted within the bow slot 540. This allows a key ring to be inserted within both key ring apertures 502, 509*b*.

The bow cap 550 also includes a magnet 501 that is encased within the body portion of the bow cap 550. The magnet 501 may be encased within at least one of two side walls of the bow cap 550. The magnet 501 may be a disk magnet or bar magnet and, in at least some embodiments, the side wall thickness of the bow cap 550 may be reduced or eliminated atop the encased magnet 501 to improve gauss strength.

The present disclosure, therefore, described magnetic keys, key components and bow caps. It will be understood embodiments described herein may be modified with features of other embodiments described herein.

The keys that are used with the embodiments described herein may, for example, include house keys, car keys, data keys, electronic keys, RFID keys, and keys of other types. The key could be an abloy key, tubular key, double sided key, four sided key or any other key.

In some embodiments, to facilitate pivotally manipulating a magnetic key assembly (or bow cap) in relation to other magnetic key assemblies when attached to an adjacent magnetic key assembly (or bow cap), the magnet may be the thickest part of the key (or bow cap). That is, in at least some embodiments, no other feature of the key (or bow cap) is thicker than the thickness of the magnet. By way of example, in some embodiments, the magnet 101 may protrude from each end by 0.2 to 0.4 mm.

Furthermore, in some embodiments, to facilitate connection with adjacent magnetic key assemblies or magnetic bow caps at the magnetic pivot point, the bow and blade of the key may be made out of a non-magnetic materials or materials that have little or no magnetic attraction, such as aluminum. Such a configuration avoids a magnet provided on one key assembly (or bow) from attaching to the adjacent key itself (rather than the magnet of the key).

Furthermore, while the "key ring aperture" was generally described as being near the top side of the bow, in some embodiments, the key ring aperture may instead be near a side of the bow, such as a left or right side. By way of example, in at least some embodiments, the gap between a left side or right side of the bow and a nearest side of the key ring aperture is four (4) millimeters or less.

Furthermore, while the term "key ring aperture" has generally been defined to include a standard key ring aperture located within four (4) millimeters of a side, in other embodiments, the key ring aperture may be a non-standard key ring aperture that is located within five (5) millimeters of a side.

Certain adaptations and modifications of the described embodiments can be made. Therefore, the above discussed embodiments are considered to be illustrative and not restrictive.

The invention claimed is:

1. A key comprising:

a blade;

a bow connected to the blade, the bow for applying torque to the blade, the bow defining a key ring aperture, the key ring aperture offset from a center of the bow such that the key ring aperture is located near a top of the bow, the top being the portion of the bow furthest from the blade; and a magnet fixedly coupled to the bow by placement within the key ring aperture to provide a magnetic field on at least one side of the key, the magnet positioned to allow the key to be optionally coupled to an adjacent key having a similarly-positioned magnet and to allow the key to be inserted into a lock while the key is coupled to the adjacent key and having a thickness greater than the thickness of the bow and protruding from the bow beyond planar surfaces of first and second planar sides of the key by between 0.2 and 0.4 millimeters to allow the key to be pivoted in relation to the adjacent key having a similarly-positioned magnet without interference between planar surfaces of the keys when the magnet is in contact with the similarly-positioned magnet, wherein the magnet is a ring magnet and wherein a gap between a side of the bow and the nearest edge of the key ring aperture is five millimeters or less to allow the key to be optionally used with a key ring, and wherein the north pole of the magnet is oriented to provide a magnetic field at the first planar side of the key and the south pole of the magnet is oriented opposite the north pole to provide a magnetic field at the second planar side of the key.

2. A key comprising:

a blade;

a bow connected to the blade, the bow for applying torque to the blade, the bow defining a key ring aperture, the key ring aperture offset from a center of the bow such that the key ring aperture is located near a top of the bow, the top being the portion of the bow furthest from the blade; and a magnet fixedly coupled to the bow by placement within the key ring aperture to provide a magnetic field on at least one side of the key, the magnet positioned to allow the key to be optionally coupled to an adjacent key having a similarly-positioned magnet and to allow the key to be inserted into a lock while the key is coupled to the adjacent key and having a thickness greater than the thickness of the bow and protruding from the bow beyond planar surfaces of first and second planar sides of the key by between 0.2 and 0.4 millimeters to allow the key to be pivoted in relation to the adjacent key having a similarly-positioned magnet without interference between planar surfaces of the keys when the magnet is in contact with the similarly-positioned magnet, wherein the magnet is a disk magnet having no hole therethrough, and wherein the north pole of the magnet is oriented to provide a magnetic field at the first planar side of the key and the south pole of the magnet is oriented opposite the north pole to provide a magnetic field at the second planar side of the key.

3. The key of claim 1, wherein the magnet defines a hole there through to permit the key ring to be received.

4. The key of claim 1, wherein the blade is cut or adapted to be cut for receipt within a key way of the lock.

5. The key of claim 1, further comprising a computer readable memory, and wherein the blade is configured for receipt within an interface provided on an electronic device which allows the computer readable memory to be accessed by the electronic device.

6. The key of claim 1, wherein the bow includes a polymer portion coating a metallic portion.

7. The key of claim 1, wherein the magnet is attached to the bow by injection molding or over molding.

8. The key of claim 1, wherein the blade includes at least one tool selected from the group comprising:

a knife;

a file; and a saw.

9. The key of claim 1, wherein the magnet is fixedly coupled to the bow by interference fit.

10. The key of claim 1, wherein the magnet is fixedly coupled to the bow by using an adhesive.

11. A bow cap for a key, the bow cap comprising:

a body portion defining a bow slot for receiving a bow of a key and a key ring aperture located between the bow slot and a top of the bow cap; and a magnet fixedly coupled to the body portion by placement within the key ring aperture to provide a magnetic field on at least one side of the bow cap, wherein the magnet is positioned to allow the key to be optionally coupled to an adjacent key received in another bow cap having a similarly-positioned magnet and to allow the key to be inserted into a lock while the key is coupled to the adjacent key and having a thickness greater than the bow cap and protruding from the bow cap by between 0.2 and 0.4 millimeters to allow the key to be pivoted in relation to the adjacent key without interference between body portions of the bow caps when the magnet is in contact with the similarly-positioned magnet.

12. The bow cap of claim 11, wherein the magnet has a south pole located to provide a magnetic field at a first side of the bow cap and a north pole located to provide a magnetic field at a second side of the bow cap, the second side of the bow cap being opposite the first side of the bow cap.

13. The bow cap of claim 11, wherein the magnet is attached to the bow cap by injection molding or over molding.

14. The bow cap of claim 11, wherein a gap between a side of the bow cap and a nearest edge of the aperture is four millimeters or less.

15. The bow cap of claim 11, wherein the magnet is a disk magnet.

16. The bow cap of claim 11, wherein the magnet is a ring magnet.

* * * * *